United States Patent [19]

Anderson et al.

[11] 4,068,250

[45] Jan. 10, 1978

[54] LEADER BELT STABILIZER

[75] Inventors: Conrad V. Anderson; William B. Kellett, both of Minneapolis, MN

[73] Assignee: Pako Corporation, Minneapolis, Minn.

[21] Appl. No.: 721,199

[22] Filed: Sept. 8, 1976

[51] Int. Cl.[2] ..... G03D 17/00

[52] U.S. Cl. ..... 354/316; 354/312; 354/321; 354/339

[58] Field of Search ..... 354/316, 312, 319–322, 354/331, 337–339

[56] References Cited

U.S. PATENT DOCUMENTS 2,770,179 11/1956 Dye et al. ..... 354/320

*Primary Examiner*—Richard L. Moses

*Attorney, Agent, or Firm*—John W. Adams

[57] ABSTRACT

A leader belt stabilizer for photographic processors designed to maintain the desired orientation of the belt, and an attachment clip and arm assembly used for transporting a strip of photographic material through a processor, which stabilizer includes a belt engaging and stabilizing element positioned immediately ahead of the belt rollers to engage the belt and straighten and stabilize immediately prior to passing around the rollers of the conveyor transport system.

7 Claims, 5 Drawing Figures

LEADER BELT STABILIZER

BACKGROUND OF THE INVENTION

Strips of photographic material are conventionally transported through the processor by means of a roller and leader belt transport system with a leader clip and cantilevered arm assembly attached to a selected portion of the leader belt. The photographic strip material has its leading end attached to the cantilevered arm. The resistence to travel of the photographic strip through the processor frequently causes the attachment clip to twist the belt and displace the attachment arm and strip inwardly where it engages portions of the processor particularly when the clip passes around a roller and the clip is frequently forceably disengaged from the belt and the strip of material (along with the clip and arm) are thus dropped into the bottom of the tank and lost.

This invention is designed to overcome this problem by providing a stabilizer for removing any twists in the belt and straightening out the clip and attaching arm immediately prior to the belt passing around the guiding rollers of the belt transport system.

SUMMARY OF THE INVENTION

This invention constitutes a leader belt stabilizer for use with a photographic processor of the type which includes a number of processing tanks, a plurality of spacing apart belt engaging rollers in said tanks positioned to define a predetermined back and forth path through said tanks, a leader belt passing successively around said rollers and following said path, and a cantilevered attachment arm with an attachment clip at one end thereof for removably connecting the arm and a strip of photographic material attached thereto to a selected portion of the leader belt, said stabilizer including a belt engaging member positioned immediately ahead of a selected belt engaging roller and aligned with the defined belt path to engage and positively orient portions of the belt immediately ahead of the selected rollers to remove any twist in the belt and straighten the strip attaching arm so that the clip and arm assembly will be carried smoothly around the rollers by said belt.

DESCRIPTION OF THE DISCLOSED EMBODIMENT

Figure 1:
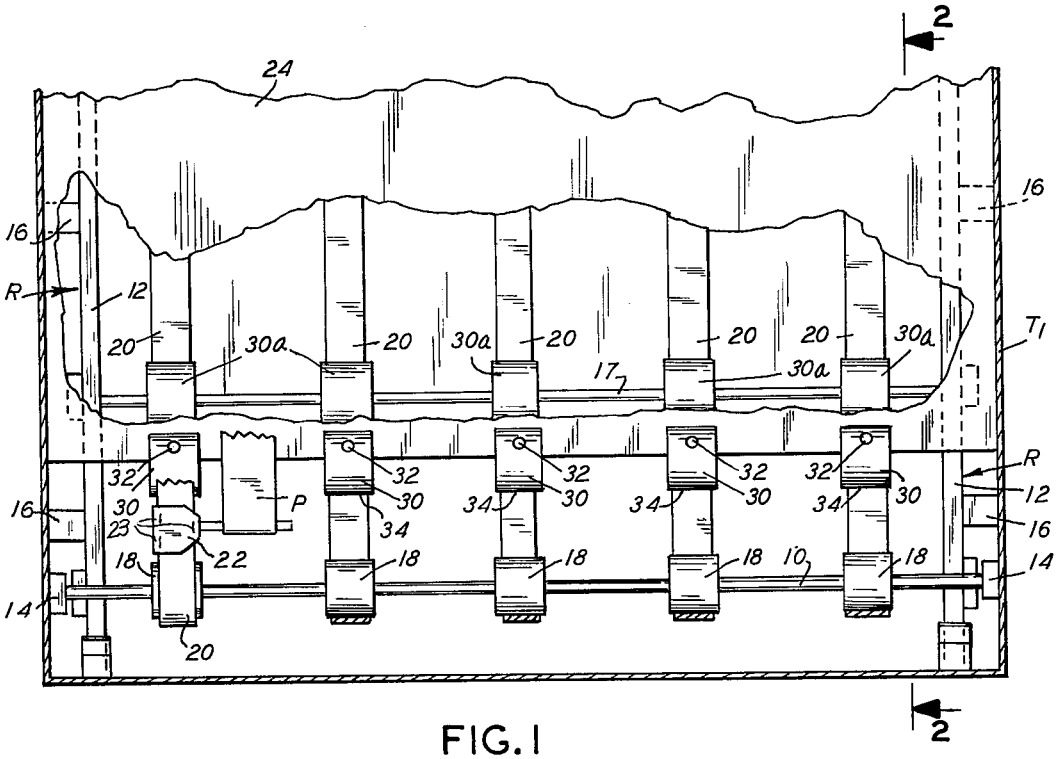
FIG. 1 is a side elevational view of a typical processing tank with portions broken away to show the leader belt assembly and stabilizers emboding this invention.

FIG. 1 illustrates a portion of a photographic paper processor having a pair of processing tanks T1 and T2. An idler roller shaft 10 is journaled on a pair of side bars as by bearing assemblies 14. The side bars are mounted in fixed spaced apart relation within a processing tank T1 as by spacer blocks 16 and a tie rod 17 which extends between and rigidly connect the pair of side bars 12 to form a mounting rack R. A plurality of rollers 18 are laterally spaced apart on an idler roller shaft 10 with leader belts 20 trained thereover. An attachment leader clip arm 22 with the leading edge of a paper strip R attached thereto is positively attached to leader belt 20 as by leader clip arm belt attaching fingers 23 thereby providing a means to transport said paper strip through the processing tanks T1 and T2 as shown. A dark wall 24 extends into T1 to isolate the portion of the process that is sensitive to light, designated by 26 in FIG. 2 The portion which is insensitive to light is designated by the numeral 28. Referring again to FIG. 1, a donut shaped clip-stabilizing member 30 is attached to said dark wall 24 in the path of each leader belt 20 and is retained in fixed position as by an anchoring screw 32.

Figure 3:
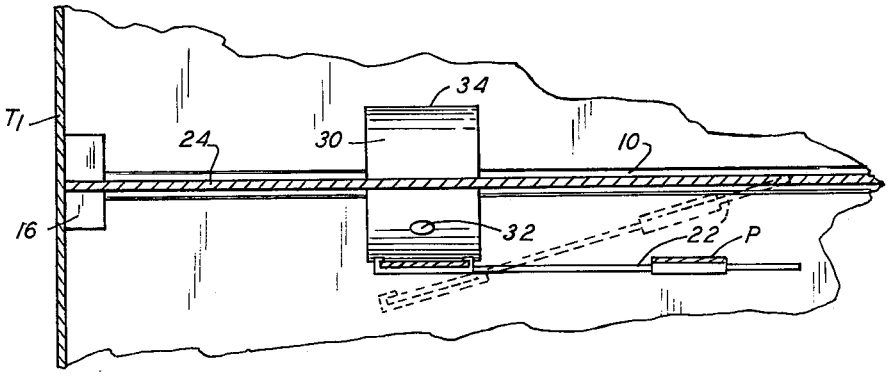
FIG. 3 is an enlarged view showing the belt stabilizer in operative belt engaging position by full lines with the twisted belt orientation shown by dotted lines.
Figure 4:
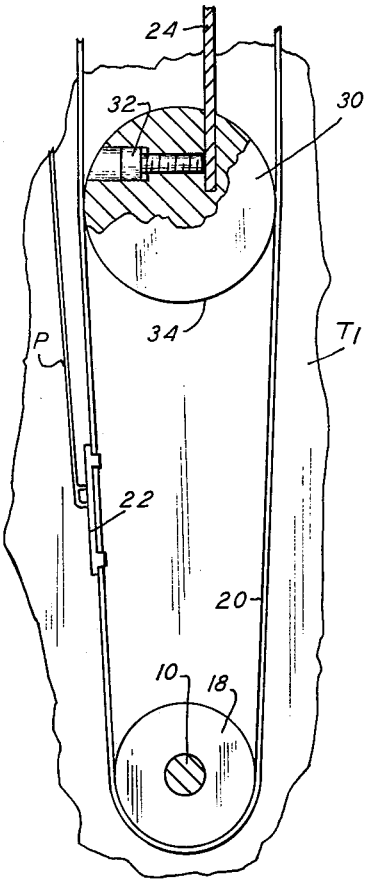
FIG. 4 is an enlarged view of the portion designated within the broken lines 5 of FIG. 2.

During the transportation of paper strip P through processing tanks T1 and T2 the leader arm 22 may become displaced as best illustrated by the alternate position shown by dashed lines in FIG. 3. The displacement is caused by numerous forces acting upon the leader arm 22. One source of such force is the turbulance induced in the processing fluid to enhance processing and maintain strength uniformity of the solution within the tank. Another cause of displacement of leader arm 22 arises from the attachment of said arm to leader belt 20 at only one end. This produces an apparatus that is prone to flutter as it passes through the processing fluid. The displacement of leader clip arm 22 is transmitted to leader belt 20 due to the rigidity of attachment thereby twisting said belt. The twist in leader belt 20 is removed by causing leader belt 20 to positively engage the camming surface 34 of donut belt stabilizer 30. This action not only removes the twist from leader belt 20 but further causes leader arm 22 to be returned to proper alignment thereby providing clearance for dark wall 24.

Figure 2:
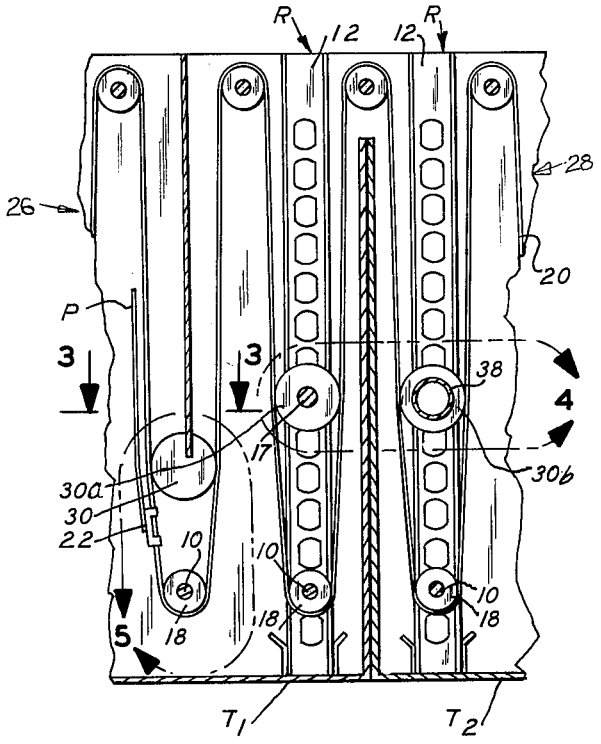
FIG. 2 is a transverse vertical sectional view taken substantially along the line 2—2 of FIG. 1.

The positive engagement of leader belt 20 with the stabilizer 30 is achieved by positioning the camming surface in laterally off-set relation to the belt path as by making the diameter of said donut larger than the spacing between the belt paths as illustrated in FIG. 2.

Figure 5:
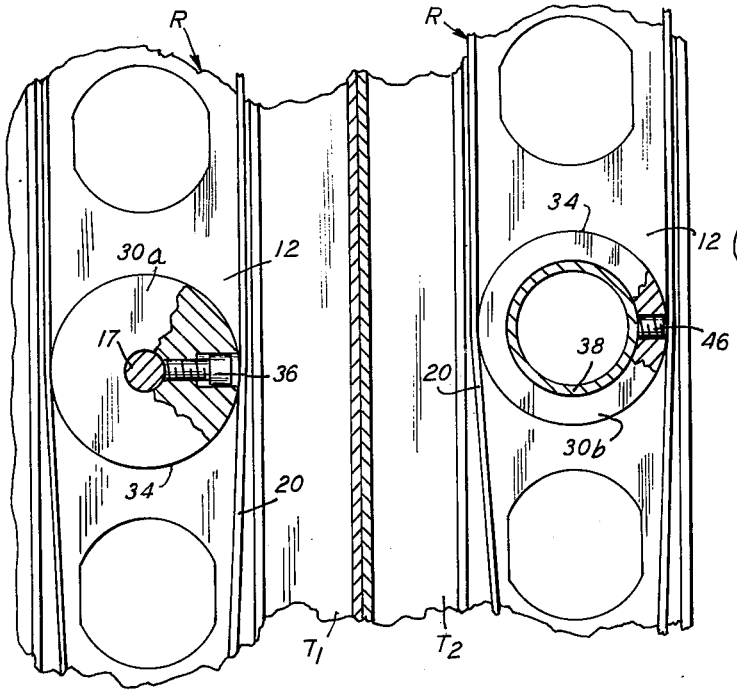
FIG. 5 is an enlarged view of the portion located within the lines 4 of FIG. 2.

FIG. 5 illustrates two additional applications of the donut clip stabilizing device in a paper processing apparatus. A plurality of donut clip stabilizers **30*a* are attached to tie rod 17 in a lateral spaced apart relation positioned in the path of leader belts 20 and retained in position as by screw 36 or other suitable means. The outside diameter of donut clip stabilizer 30*a* is the same as that of donut clip stabilizer 30, and as such causes positive engagement of leader belt 20 with donut camming surface 34 thereby removing the twist from said belt and causing leader clip arm 22 to be realigned to provide clearance between said leader arm and tie rod 17. In the case of donut clip stabilizer 30*a*, leader clip arm 22 is positioned to clear tie rod 17 on both the downward and upward transportation, as shown in FIG. 5. FIG. 5 further illustrates a plurality of donut clip stabilizer devices 30*b* attached to a turbulator bar 38 in lateral spaced apart relation positioned in the path of leader belts 20 and retained in position as by screw 46 or other suitable means. The outside diameter of donut clip stabilizer device 30*b* is larger than the spacing between belt paths thereby causing positive engagement of leader belt 20 with donut bearing surface 34, thus removing the twist from said belt and causing leader clip arm 22** to be realigned.

It will, of course, be understood that various changes may be made in the form, details, arrangement and proportions of the parts without departing from the scope of this invention, which generally stated is set forth in the appended claims.

What is claimed is:

1. A leader belt stabilizer for use with a photographic processor of the type including:

a plurality of processing tanks, a plurality of spaced apart belt engaging rollers in said tanks positioned to define a predetermined belt path through said tanks, a leader belt passing successively around said rollers and following said path, a cantilevered attachment arm removably connected at one end to a selected portion of the belt to transport a strip of photographic material through said tanks, said stabilizer comprising:

a belt engaging stabilizer member immediately ahead of selected belt engaging rollers and aligned with the defined belt path to engage the belt portions located immediately ahead of the selected rollers and align said engaged belt portions with the rollers and substantially remove the twist in the belt ahead of said rollers.

2. The device of claim 1 wherein said stabilizing device width is substantially equal to the width of said leader belt.

3. The device of claim 1 and said stabilizer including a camming surface to provide progressive engagement between said leader belt and said stabilizer for removing any twist from said belt ahead of said rollers.

4. The device of claim 3 wherein said stabilizing device is generally circular in cross section and has a diameter greater than the spacing between the adjacent belt paths thereby progressively engaging said belt on both sides of said selected rollers.

5. The structure set forth in claim 1 wherein said processor also includes a transverse rod disposed in spaced substantially parallel relation to the axis of said rollers and wherein said stabilizing member is mounted on said rod.

6. The structure set forth in claim 1 wherein said photographic processor includes a hollow turbulator bar oriented in spaced parallel relation to the axis of said rollers, and wherein said stabilizer member is mounted on said turbulator bar.

7. The structure set forth in claim 1 wherein said photographic processor includes a dark well extending downwardly into one of said tanks in closely spaced relation to said roller and wherein said stabilizer member is attached to said dark wall.

* * * * *